US005345960A

United States Patent [19]

Tung

[11] Patent Number: 5,345,960

[45] Date of Patent: Sep. 13, 1994

[54] CONNECTING PIECE FOR LARGE UMBRELLAS

[76] Inventor: Pai-Feng Tung, No. 20, Lane 673, Chung Cheng Rd., Yi Chia Tsun, Jen Teh Hsiang, Tainan Hsien, Taiwan

[21] Appl. No.: 91,151

[22] Filed: Jul. 12, 1993

[51] Int. Cl.[5] ..... A45B 25/00

[52] U.S. Cl. ..... 135/32; 135/26; 403/79

[58] Field of Search ..... 135/32, 26, 28, 29, 135/31, 73; 403/66, 79, 187; 52/731.7

[56] References Cited

U.S. PATENT DOCUMENTS

| | | | |
|---|---|---|---|
| 418,009 | 12/1889 | Gocht | 403/66 |
| 1,862,674 | 6/1932 | Frey | 135/32 |
| 4,286,351 | 9/1981 | Mower et al. | 403/79 X |
| 4,896,987 | 1/1990 | Pethors | 403/29 X |

FOREIGN PATENT DOCUMENTS

| | | | |
|---|---|---|---|
| 1173216 | 7/1964 | Fed. Rep. of Germany | 135/26 |
| 2635445 | 2/1990 | France | 135/32 |

*Primary Examiner*—Carl D. Friedman
*Assistant Examiner*—Creighton Smith
*Attorney, Agent, or Firm*—Peterson, Wicks, Nemer & Kamrath

[57] ABSTRACT

A large umbrella includes a plurality of ribs and stretchers and a connecting piece mounted to a mediate section of each rib for connecting the rib and associated stretcher. The connecting piece is substantially U-shaped and has a base section with two ends and a lateral wall extending from each end of the base section. A protrusion projects from an inner side of each lateral wall to form a pair of aligned protrusions adjacent to the base section for securely engaging with the rib. A pair of aligned holes are formed in the lateral walls adjacent to the distal ends of the lateral walls for allowing riveting of the stretcher.

8 Claims, 6 Drawing Sheets

CONNECTING PIECE FOR LARGE UMBRELLAS

BACKGROUND OF THE INVENTION

1. Field of the Invention

The present invention relates to an improved connecting piece for a large umbrella, such as a large beach or garden umbrella.

2. Description of Related Art

Large umbrellas are widely used in beaches, gardens, and other places. In a conventional design for large umbrellas, the connecting piece placed in a middle of a rib for connecting the rib and an associated stretcher requires three rivets, having the following disadvantages: (1) the assembling procedure is too complex, (2) the assembling cost is high, and (3) the strength thereof is insufficient. The present invention provides an improved connecting piece to solve these problems.

SUMMARY OF THE INVENTION

The present invention provides a large umbrella comprising a plurality of ribs and stretchers and a connecting piece mounted to a mediate section of each rib for connecting the rib and associated stretcher. The connecting piece is substantially U-shaped and comprises a base section with two ends and a lateral wall extending from each end of the base section. A protrusion projects from an inner side of each lateral wall to form a pair of aligned protrusions adjacent to the base section for securely engaging with the rib. A pair of aligned holes are formed in the lateral walls adjacent to the distal ends of the lateral walls for riveting the stretcher.

Preferably, between the holes and protrusions of the connecting piece, a guiding ridge extends outward from the inner side of each lateral wall, dividing the U-shaped connecting piece into an inner space and an outer space accessible to the inner space. Each guiding ridge has a guiding surface which faces the outer space and tapers toward the base section, thereby assisting the insertion of the rib into the inner space and thus securely holding the rib in the inner space.

Other objects, advantages, and novel features of the invention will become more apparent from the following detailed description when taken in conjunction with the accompanying drawings.

DESCRIPTION OF THE PREFERRED EMBODIMENTS

Figure 10:
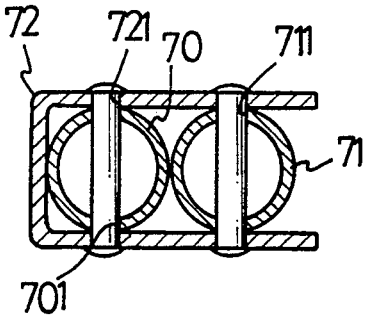
FIG. 10 PRIOR ART
FIG. 10 is a cross-sectional view illustrating the structure of the rib, the stretcher, and the conventional connecting piece after assembling.
Figure 8:
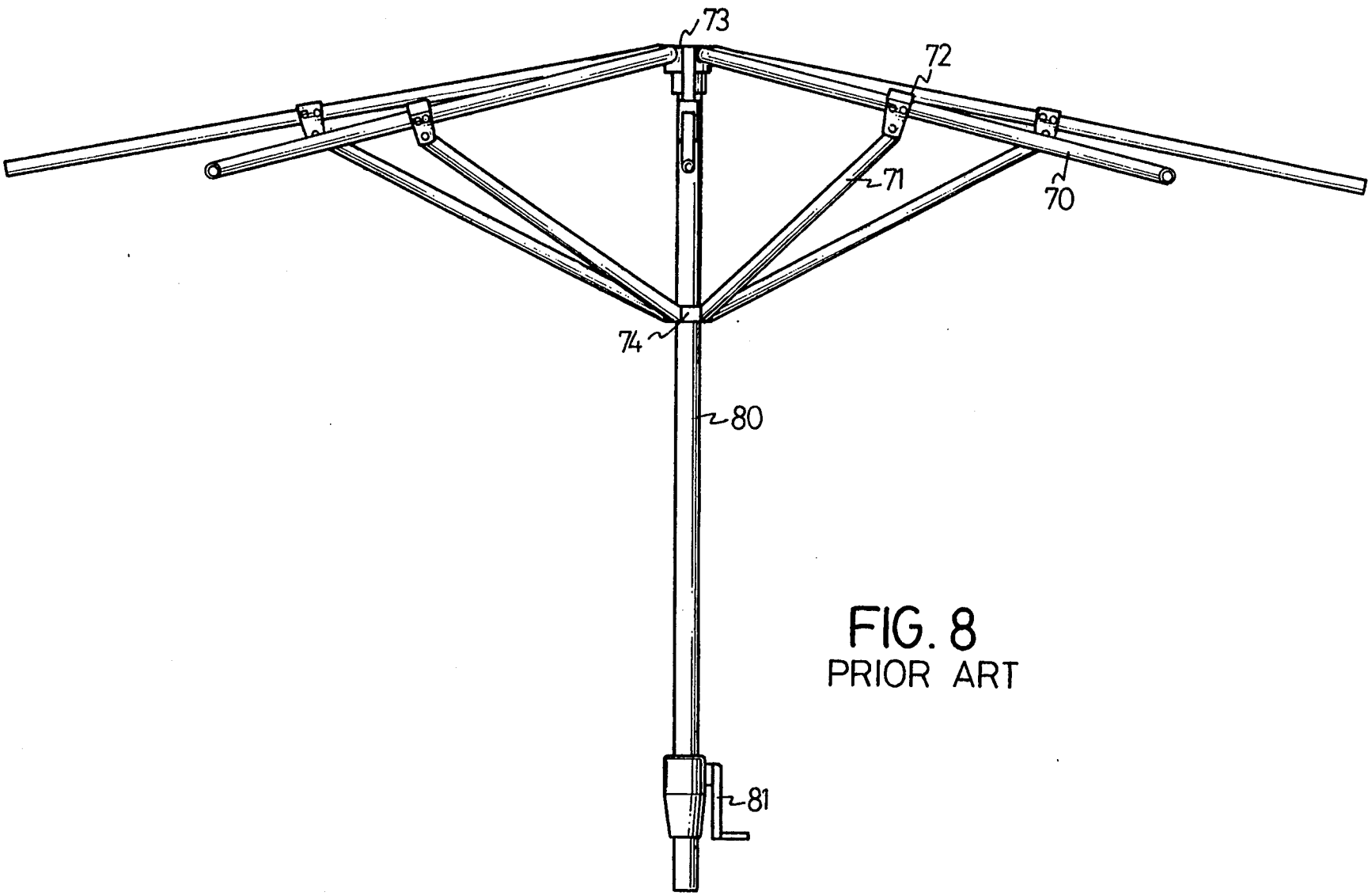
FIG. 8 PRIOR ART
FIG. 8 is a perspective view showing a conventional large umbrella.
Figure 9:
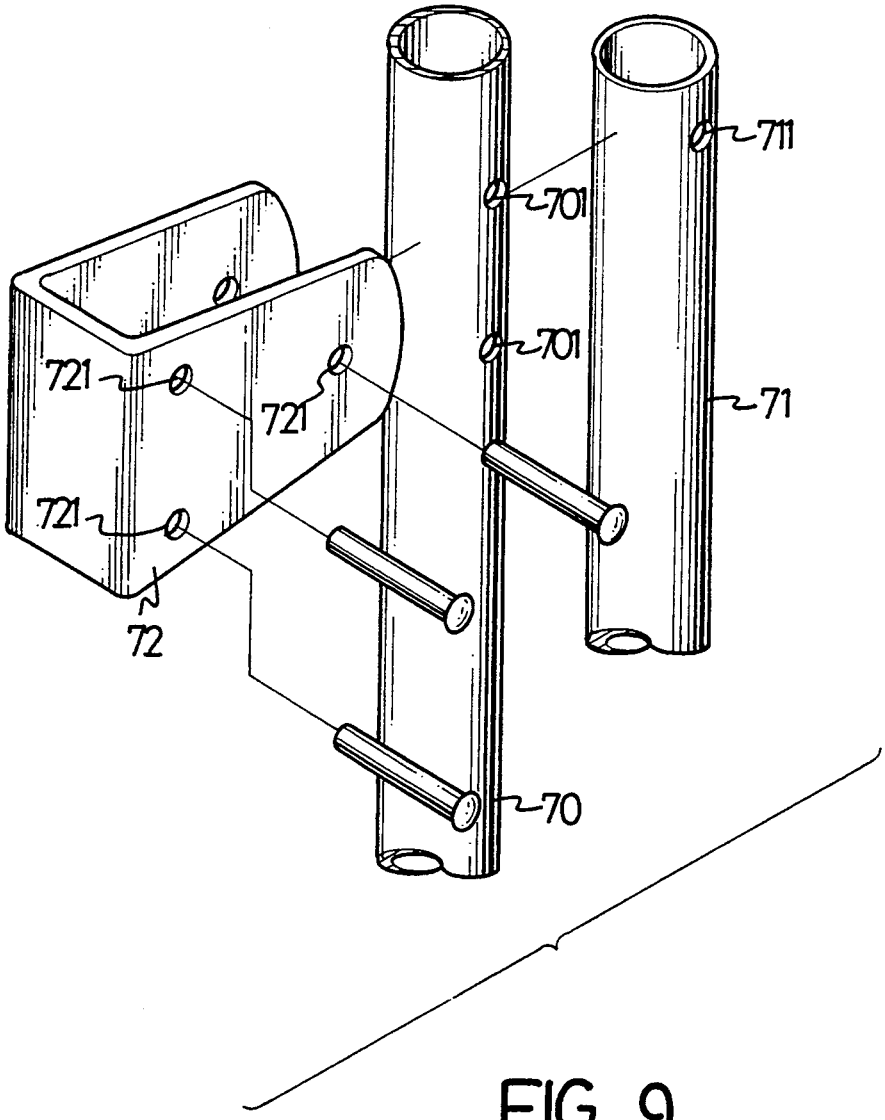
FIG. 9 PRIOR ART
FIG. 9 is an exploded view of a conventional connecting piece.

For a better understanding of the background of the invention, reference is made to FIGS. 8 through 10 in which a conventional large umbrella is shown. A conventional large umbrella generally includes a rod 80, a plurality of radially disposed ribs 70 with their first ends thereof connected to a common top 73, a plurality of stretchers 71 each having a first end and a second end, and a connecting piece 72 provided to a mediate section of each rib 70 to connect the first end of the stretcher 71 and the rib 70. The lower ends of the stretchers 71 are connected to a runner 74 which is movable along the rod 80 under operation of a winch 81 disposed to a lower section of the rod 80. Construction and operation of the winch 30 will not be described herein as being conventional and beyond the scope of the invention.

Referring to FIGS. 9 and 10, each rib 70 has two transverse through holes 701 therein and the stretcher 71 has a transverse through hole 711 therein, while the connecting piece 72 is substantially U-shaped and has three pairs of holes 721 to connect the rib 70 and the stretcher 71 by riveting three rivets (not labeled) in associated through holes. In such an arrangement, three riveting procedures have to be performed to connect a rib 70 and a stretcher 71. For an umbrella with eight ribs, twenty-four riveting procedures have to be performed. This causes a high cost in assembling the large umbrellas as they are assembled manually. Furthermore, the two transverse through holes 701 in the rib 70 are too close to each other, and so the strength of the rib 70 is affected.

The present invention provides an improved connecting piece structure to solve the above problems.

Figure 1:
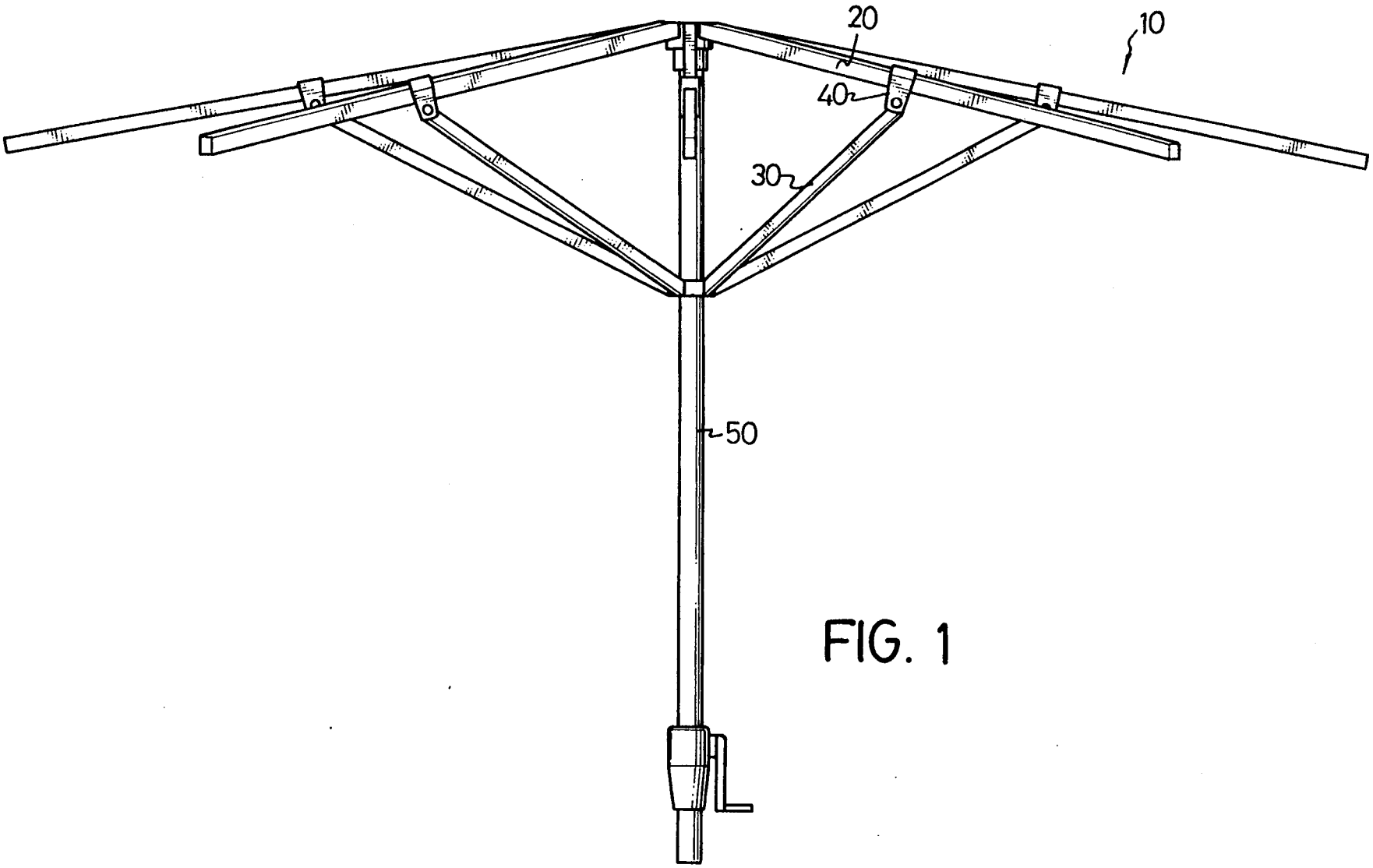
FIG. 1 is a perspective view of a large umbrella in accordance with the present invention.
Figure 2:
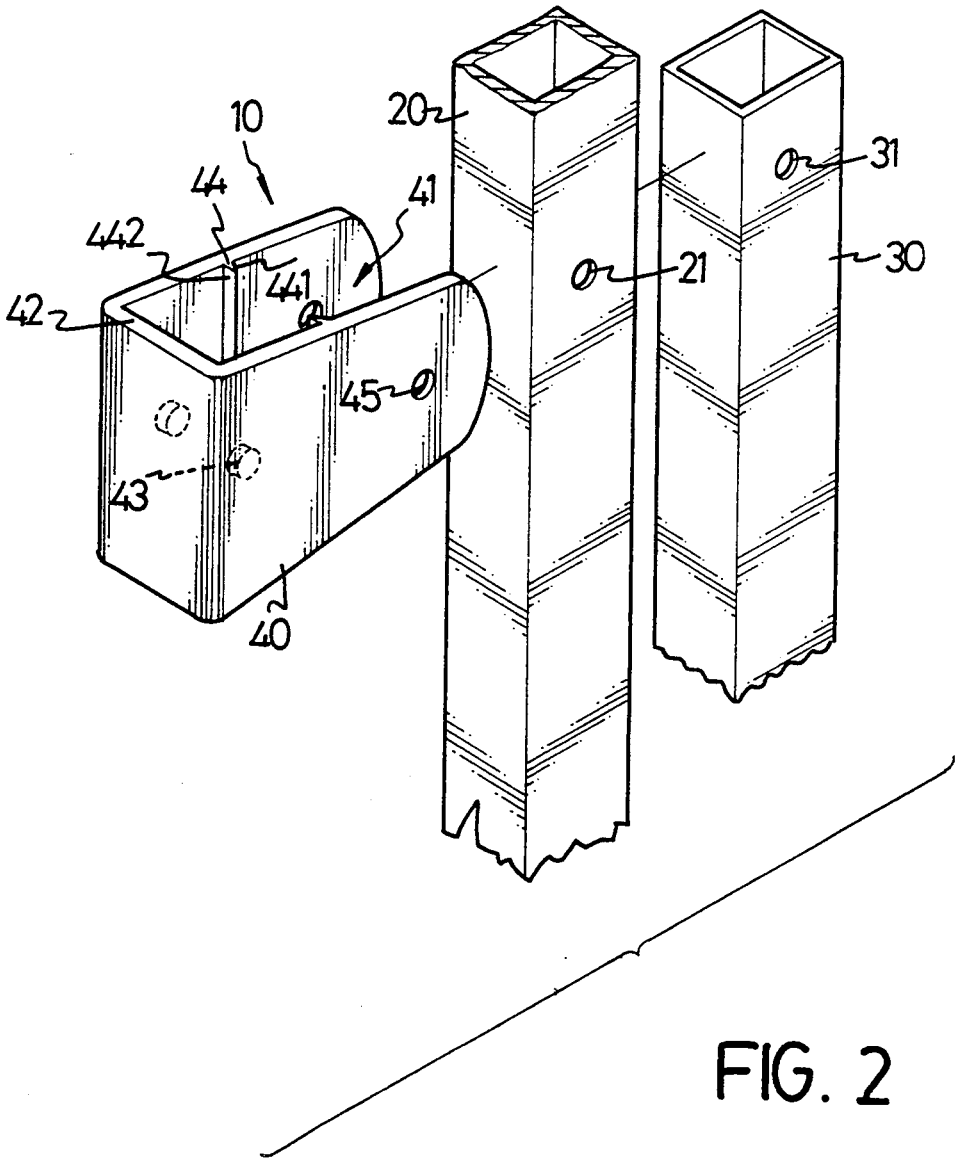
FIG. 2 is an exploded view showing the connecting piece in accordance with the present invention.

Referring now to FIGS. 1 through 7 and initially to FIGS. 1 and 2, a large umbrella in accordance with the present invention is designated by "10" and generally includes a rod 50, a plurality of ribs 20, a plurality of stretchers 30, and a connecting piece 40 provided to a mediate section of each rib 20 to connect the rib 20 and associated stretcher 30. The rib 20 is substantially tubular and rectangular in section and has a transverse through hole 21, while the stretcher 30 is also substantially tubular and rectangular in section and has a transverse through hole 31.

As shown in FIG. 2, the connecting piece 40 is substantially U-shaped, including a base section 42 and a lateral wall 41 extending from each end of the base section 42. A protrusion 43 projects from an inner side of each lateral wall 41 to form a pair of aligned protrusions 43 adjacent to the base section 42. A pair of aligned holes 45 being formed on the lateral walls 41. Between the holes 45 and the protrusions 43, a guiding ridge 44 extends outward from the inner side of each lateral wall 41, dividing the U-shaped connecting piece into an inner space and an outer space. Each guiding plate 44 has a guiding surface 441 which faces the outer space and tapers toward the base section 42, whose function will be described hereinbelow.

Figure 3:
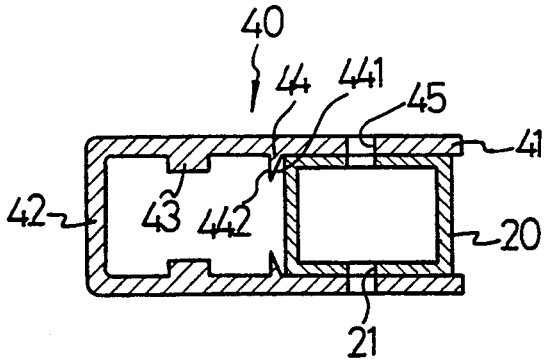
FIGS. 3 through 5 are cross-sectional views illustrating the assembling procedure of the connecting piece and the rib.
Figure 4:
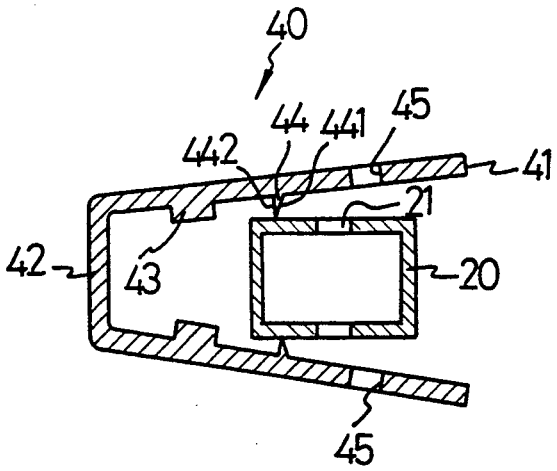
Figure 5:
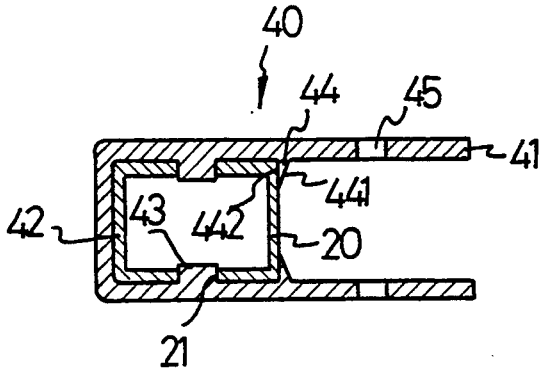

FIGS. 3 through 5 illustrate the assembling of the rib 20 and the connecting piece 40. In FIG. 3, the rib 20 is inserted into the connecting piece 40 via the open end of the latter (not labeled) until the former is stopped by the guiding plates 44. In FIG. 4, the assembler may apply a larger force to forcibly pass the rib 20 through the guiding plates 44 as the rib 20 may slide over the guiding surfaces 441. It is appreciated that the lateral walls 41 moved outwardly to allow the further insertion of the rib 20 when the rib 20 was passing through the guiding plates 44, as shown in FIG. 4. The rib 20 is fittingly received in the inner space defined by the inner side of the base section 42 and the second surfaces 442 of the guiding plates 44, with the through hole 21 engaging with the protrusions 43, as shown in FIG. 5.

Figure 7:
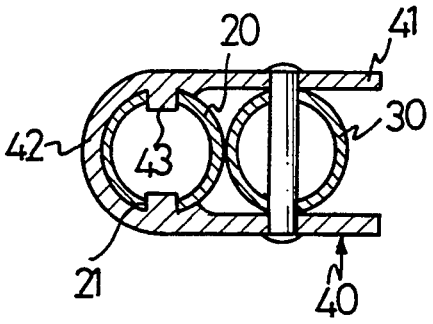
FIG. 7 is a cross-sectional view illustrating another embodiment of the present invention.
Figure 6:
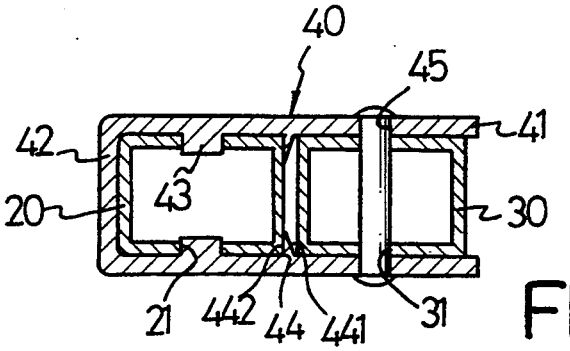
FIG. 6 is a cross-sectional view showing the structure of the rib, the stretcher, and the connecting piece after assembling.

Thereafter, the stretcher 30 is inserted to the outer space of the connecting piece 40, and is riveted in position after the through hole 31 is in alignment with the holes 45, as shown in FIG. 6. By such an arrangement, the assembling procedure is much simpler than prior art. FIG. 7 shows another embodiment of the present invention in which the base section 42 of the connecting piece 40 is concave, while the rib 20 is substantially circular in section. As can be seen in this figure, the guiding plates 44 in the first embodiment are omitted without affecting the fitting engagement between the through hole 21 of the rib 20 and the protrusions 43 of the connecting piece 40. Alternatively, the stretcher 30 may also be circular in section without affecting the riveting between it and the connecting piece 40.

Although the invention has been explained in relation to its preferred embodiment, it is to be understood that many other possible modifications and variations can be made without departing from the spirit and scope of the invention as hereinafter claimed.

I claim:

1. A connecting piece for a large umbrella with a plurality of ribs and stretchers, said connecting piece being substantially U-shaped and comprising a base section (42) with two ends and a lateral wall (41) having distal ends extending from each said end of said base section (42), a protrusion (43) projecting from an inner side of each said lateral wall to form a pair of aligned protrusions (43) adjacent to said base section (41) adapted to securely engage with a through hole (21) of a rib (20), and a pair of aligned holes (45) being formed in said lateral walls (41) adjacent to the distal ends of said lateral walls (41).

2. The connecting piece as claimed in claim 1 wherein a guiding ridge (44) extends between said holes (45) and said protrusions (43) from said inner side of each said lateral wall (41), dividing the U-shaped connecting piece into an inner space and an outer space accessible to said inner space.

3. The connecting piece as claimed in claim 2 wherein each said guiding ridge (44) has a guiding surface (441) which faces said outer space and tapers toward said base section (42).

4. A large umbrella comprising a plurality of ribs and stretchers and a connecting piece mounted to a mediate section of each said rib for connecting said rib and associated said stretcher, the improvement comprising:

said connecting piece being substantially U-shaped and comprising a base section (42) with two ends and a lateral wall (41) having distal ends extending from each said end of said base section (42), a protrusion (43) projecting from an inner side of each said lateral wall to form a pair of aligned protrusions (43) adjacent to said base section (41) for securely engaging with said rib (20), a pair of aligned holes (45) being formed in said lateral walls (41) adjacent to the distal ends of said lateral walls (41).

5. The large umbrella as claimed in claim 4 wherein a guiding ridge (44) extends between said holes (45) and said protrusions (43) from said inner side of each said lateral wall (41), dividing the U-shaped connecting piece into an inner space and an outer space accessible to said inner space.

6. The large umbrella as claimed in claim 5 wherein each said guiding ridge (44) has a guiding surface (441) which faces said outer space and tapers toward said base section (42).

7. The large umbrella as claimed in claim 4 wherein the rib and the stretcher are substantially tubular and rectangular in section.

8. The large umbrella as claimed in claim 4 wherein the rib and the stretcher are substantially tubular and circular in section.

* * * * *